US007909711B2

(12) United States Patent
Sullivan et al.

(10) Patent No.: US 7,909,711 B2
(45) **Date of Patent: *Mar. 22, 2011**

(54) HIGH PERFORMANCE GOLF BALL HAVING A REDUCED-DISTANCE

(75) Inventors: Michael J. Sullivan, Barrington, RI (US); Steven Aoyama, Marion, MA (US); Edmund A. Hebert, Fairhaven, MA (US); Derek A. Ladd, Acushnet, MA (US); William E. Morgan, Barrington, RI (US); Michael D. Jordan, Newport, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/352,047

(22) Filed: Jan. 12, 2009

(65) Prior Publication Data

US 2009/0124425 A1 May 14, 2009

Related U.S. Application Data

(63) Continuation of application No. 11/214,428, filed on Aug. 29, 2005, now Pat. No. 7,481,723, which is a continuation-in-part of application No. 11/108,812, filed on Apr. 19, 2005, now Pat. No. 7,156,757, which is a continuation of application No. 10/784,744, filed on Feb. 24, 2004, now Pat. No. 6,913,550, which is a continuation of application No. 10/096,852, filed on Mar. 14, 2002, now Pat. No. 6,729,976.

(51) Int. Cl.
*A63B 37/12* (2006.01)

(52) U.S. Cl. ..... 473/378

(58) Field of Classification Search ..... 473/351, 473/378, 383–385

See application file for complete search history.

(56) References Cited

U.S. PATENT DOCUMENTS

| | | | | |
|---|---|---|---|---|
| 2,356,128 | A | 8/1944 | Thomas et al. | |
| 3,099,644 | A | 7/1963 | Parker et al. | |
| 3,642,728 | A | 2/1972 | Canter | |
| 4,229,337 | A | 10/1980 | Brenner | |
| 4,560,168 | A | 12/1985 | Aoyama | |
| 4,836,552 | A | 6/1989 | Puckett et al. | |
| 4,839,116 | A | 6/1989 | Puckett et al. | |
| 4,925,193 | A | 5/1990 | Melvin et al. | |
| 4,948,143 | A | 8/1990 | Aoyama | |
| 5,209,485 | A * | 5/1993 | Nesbitt et al. | 473/372 |

(Continued)

FOREIGN PATENT DOCUMENTS

| | | |
|---|---|---|
| WO | WO 00/23519 | 4/2000 |

(Continued)

OTHER PUBLICATIONS

"USGA letter to manufacturer takes ball debate to new level," by D. Seanor, Golfweek, pp. 4, 26, Apr. 23, 2005.

*Primary Examiner* — Raeann Trimiew
(74) *Attorney, Agent, or Firm* — William B. Lacy

(57) ABSTRACT

A golf ball including a core and a cover layer, wherein the golf ball has a weight of about 1.39 oz to about 1.62 oz, and at a Reynolds number of about 138,000 and a non-dimensional spin ratio of about 0.142, the golf ball has a lift-to-weight ratio of greater than about 0.9 and a drag-to-weight ratio of greater than about 1.2.

14 Claims, 8 Drawing Sheets

U.S. PATENT DOCUMENTS 5,249,804 A 10/1993 Sanchez
5,273,287 A 12/1993 Molitor et al.
5,415,410 A 5/1995 Aoyama
5,433,447 A 7/1995 Pocklington
5,470,075 A 11/1995 Nesbitt et al.
5,497,996 A 3/1996 Cadorniga
5,562,552 A 10/1996 Thurman
5,569,100 A 10/1996 Molitor et al.
5,575,477 A 11/1996 Hwang
5,588,924 A 12/1996 Sullivan et al.
5,601,503 A 2/1997 Yamagishi et al.
5,682,230 A 10/1997 Anfinsen et al.
5,688,191 A 11/1997 Cavallaro et al.
5,692,974 A 12/1997 Wu et al.
5,702,311 A 12/1997 Higuchi et al.
5,713,801 A 2/1998 Aoyama
5,779,564 A 7/1998 Nakamura et al.
5,783,293 A 7/1998 Lammi
5,803,831 A 9/1998 Sullivan et al.
5,803,832 A 9/1998 Nakamura et al.
5,803,833 A 9/1998 Nakamura et al.
5,807,192 A 9/1998 Yamagishi et al.
5,813,923 A 9/1998 Cavallaro et al.
5,885,172 A 3/1999 Hebert et al.
5,919,100 A 7/1999 Boehm et al.
5,957,786 A 9/1999 Aoyama
5,957,787 A 9/1999 Hwang
5,965,669 A 10/1999 Cavallaro et al.
5,981,654 A 11/1999 Rajagopalan
5,981,658 A 11/1999 Rajagopalan et al.
6,149,535 A 11/2000 Bissonnette et al.
6,152,834 A 11/2000 Sullivan
6,186,002 B1 2/2001 Lieberman et al.
6,285,445 B1 9/2001 Winfield et al.
6,299,552 B1 10/2001 Morgan et al.
6,338,684 B1 1/2002 Winfield et al.
6,346,054 B1 2/2002 Shimosaka et al.
6,358,161 B1 3/2002 Aoyama
6,394,913 B1 * 5/2002 Nesbitt et al. ..... 473/371
6,419,535 B1 7/2002 Herrera
6,527,653 B2 3/2003 Winfield et al.
6,527,654 B2 3/2003 Sajima
6,530,850 B2 3/2003 Sajima
6,595,876 B2 7/2003 Kasashima et al.
6,620,060 B2 9/2003 Ogg et al.
6,663,194 B2 12/2003 Cheong
6,682,441 B2 1/2004 Winfield et al.
6,682,442 B2 1/2004 Winfield
6,699,143 B2 3/2004 Nardacci et al.
6,705,959 B2 3/2004 Morgan et al.
6,709,348 B1 3/2004 Lemons et al.
6,726,577 B1 4/2004 Peterson
6,726,869 B2 4/2004 Aoyama et al.
6,729,976 B2 5/2004 Bissonnette et al.
6,743,124 B2 6/2004 Tsunoda et al.
6,761,647 B2 7/2004 Kasashima
6,796,912 B2 9/2004 Dalton et al.
6,800,041 B2 10/2004 Fushihara
6,814,677 B2 11/2004 Ogg
6,843,736 B2 1/2005 Kasashima
6,913,550 B2 7/2005 Bissonnette et al.
7,481,723 B2 * 1/2009 Sullivan et al. ..... 473/378
2001/0009310 A1 7/2001 Hebert et al.
2004/0116198 A1 6/2004 Schudel

FOREIGN PATENT DOCUMENTS

WO WO 00/29129 5/2000

* cited by examiner

HIGH PERFORMANCE GOLF BALL HAVING A REDUCED-DISTANCE

CROSS-REFERENCE TO RELATED APPLICATIONS

This application is a continuation of U.S. patent application Ser. No. 11/214,428, filed Aug. 29, 2005, now U.S. Pat. No. 7,481,723 which is a continuation-in-part of application Ser. No. 11/108,812 now U.S. Pat. No. 7,156,757, filed Apr. 19, 2005, which is a continuation of application Ser. No. 10/784,744, now U.S. Pat. No. 6,913,550, filed Feb. 24, 2004, which is a continuation of application Ser. No. 10/096,852, now U.S. Pat. No. 6,729,976, filed Mar. 14, 2002, each of which are incorporated by reference herein in their entirety.

FIELD OF THE INVENTION

The present invention relates to golf balls, and more particularly, to a golf ball having a reduced distance while maintaining the appearance of a normal high performance trajectory.

BACKGROUND OF THE INVENTION

Solid golf balls typically include single-layer, dual-layer (i.e., solid core and a cover), and multi-layer (i.e., solid core of one or more layers and/or a cover of one or more layers) golf balls. Solid balls have traditionally been considered longer and more durable than predecessor wound balls. Dual-layer golf balls are typically made with a single solid core encased by a cover. These balls are generally most popular among recreational golfers, because they are durable and provide maximum distance. Typically, the solid core is made of polybutadiene cross-linked with zinc diacrylate and/or similar crosslinking agents. The cover material is a tough, cut-proof blend of one or more materials known as ionomers, such as SURLYN®, sold commercially by DuPont or IOTEK®, sold commercially by Exxon.

Multi-layer golf balls may have multiple core layers, multiple intermediate layers, and/or multiple cover layers. They tend to overcome some of the undesirable features of conventional two-layer balls, such as hard feel and less control, while maintaining the positive attributes, such as increased initial velocity and distance. Further, it is desirable that multi-layer balls have a "click and feel" similar to wound balls.

Additionally, the spin rates of golf balls affect the overall control of the balls in accordance to the skill level of the players. Low spin rates provide improved distance, but make golf balls difficult to stop on shorter shots, such as approach shots to greens. High spin rates allow more skilled players to maximize control of the golf ball, but adversely affect driving distance. To strike a balance between the spin rates and the playing characteristics of golf balls, additional layers, such as intermediate layers, outer core layers and inner cover layers are added to the solid core golf balls to improve the playing characteristics of the ball.

By altering ball construction and composition, manufacturers can vary a wide range of playing characteristics, such as resilience, durability, spin, and "feel," each of which can be optimized for various playing abilities. One golf ball component, in particular, that many manufacturers are continually looking to improve is the center or core. The core is the "engine" that influences the golf ball to go longer when hit by a club head. Generally, golf ball cores and/or centers are constructed with a polybutadiene-based polymer composition. Compositions of this type are constantly being altered in an effort to provide a targeted or desired coefficient of restitution (COR), while at the same time resulting in a lower compression which, in turn, can lower the golf ball spin rate and/or provide better "feel."

The dimples on a golf ball are used to adjust the aerodynamic characteristics of a golf ball and, therefore, the majority of golf ball manufacturers research dimple patterns, shape, volume, and cross-section in order to improve overall flight distance of a golf ball. Determining specific dimple arrangements and dimple shapes that result in an aerodynamic advantage involves the direct measurement of aerodynamic characteristics. These aerodynamic characteristics define the forces acting upon the golf ball throughout flight.

Aerodynamic forces acting on a golf ball are typically resolved into orthogonal components of lift and drag. Lift is defined as the aerodynamic force component acting perpendicular to the flight path. It results from a difference in pressure that is created by a distortion in the air flow that results from the back spin of the ball. A boundary layer forms at the stagnation point of the ball, B, then grows and separates at points S1 and S2, as shown in FIG. 1. Due to the ball backspin, the top of the ball moves in the direction of the airflow, which retards the separation of the boundary layer. In contrast, the bottom of the ball moves against the direction of airflow, thus advancing the separation of the boundary layer at the bottom of the ball. Therefore, the position of separation of the boundary layer at the top of the ball, S1, is further back than the position of separation of the boundary layer at the bottom of the ball, S2. This asymmetrical separation creates an arch in the flow pattern, requiring the air over the top of the ball to move faster and, thus, have lower pressure than the air underneath the ball.

Drag is defined as the aerodynamic force component acting parallel to the ball's flight direction. As the ball travels through the air, the air surrounding the ball has different velocities and, accordingly, different pressures. The air exerts maximum pressure at the stagnation point, B, on the front of the ball, as shown in FIG. 1. The air then flows over the sides of the ball and has increased velocity and reduced pressure. The air separates from the surface of the ball at points S1 and S2, leaving a large turbulent flow area with low pressure, i.e., the wake. The difference between the high pressure in front of the ball and the low pressure behind the ball reduces the ball speed and acts as the primary source of drag for a golf ball.

Advances in golf ball compositions and dimple designs have caused some high performance golf balls to exceed the maximum distance allowed by the United States Golf Associates (USGA), when hit by a professional golfer. The maximum distance allowed by the USGA is 317 yards±3 yards, when impacted by a standard driver at 176 feet per second and at a calibrated swing condition of 10°, 2520 RPM, and 175 MPH with a calibrated ball. According to the USGA, there are at least five factors that contribute to this increase in distance, including: clubhead composition and design, increased athleticism of elite players, balls with low spin rates and enhanced aerodynamics, optimization in matching balls, shafts, and clubheads to a golfer's individual swing characteristics, and improved golf course agronomy. Even though numerous factors influence the increase in distance, golf traditionalists have been demanding that the USGA roll back the distance standard for golf balls to preserve the game. The USGA has recently instituted a research project to design and make a prototype golf ball that would reduce the maximum ball distance by 15 or 25 yards. (See "USGA letter to manufactures takes ball debate to new level," by D. Seanor, Golfweek, pp. 4, 26, Apr. 23, 2005).

The patent literature contains a number of references that discuss reduction of the distance that golf balls fly. As disclosed in U.S. Pat. No. 5,209,485 to Nesbitt, a reduction in the distance that a range ball will travel may be obtained by a combination of inefficient dimple patterns on the ball cover and low resilient polymeric compositions for the ball core. Low resilient compositions are disclosed to include a blend of a commonly used diene rubber, such as high cis-polybutadiene, and a low resilient halogenated butyl rubber. Inefficient dimple patterns are disclosed to include an octahedral pattern with a dimple free equator and a dimple coverage of less than 50%. As disclosed in the '485 patent, the resulting range ball travels about 50 yards less than comparative balls and has a lower coefficient of restitution than the coefficient of restitution of comparative balls. The '485 patent theorizes that about 40% of the reduction in distance is attributable to the inefficient design, and about 60% is attributable to the low resilient ball composition. Range balls, however, do not have the desirable feel or trajectory of high performance balls. Further, the art does not suggest a way to fine-tune the distance of high performance golf balls to adhere to a shorter USGA maximum distance, while maintaining the appearance of a high performance trajectory.

As such, there remains a need in the art to achieve a golf ball that flies shorter than the current performance balls and maintains the appearance of a high performance trajectory without adversely affecting the ball's other desired qualities, such as durability, spin, and "feel."

SUMMARY OF THE INVENTION

The present invention is directed to a high performance golf ball having a reduced overall distance while maintaining the appearance of a high performance trajectory.

BRIEF DESCRIPTION OF THE DRAWINGS

These and other aspects of the present invention may be more fully understood with reference to, but not limited by, the following drawings.

DETAILED DESCRIPTION OF THE INVENTION

Figure 1:
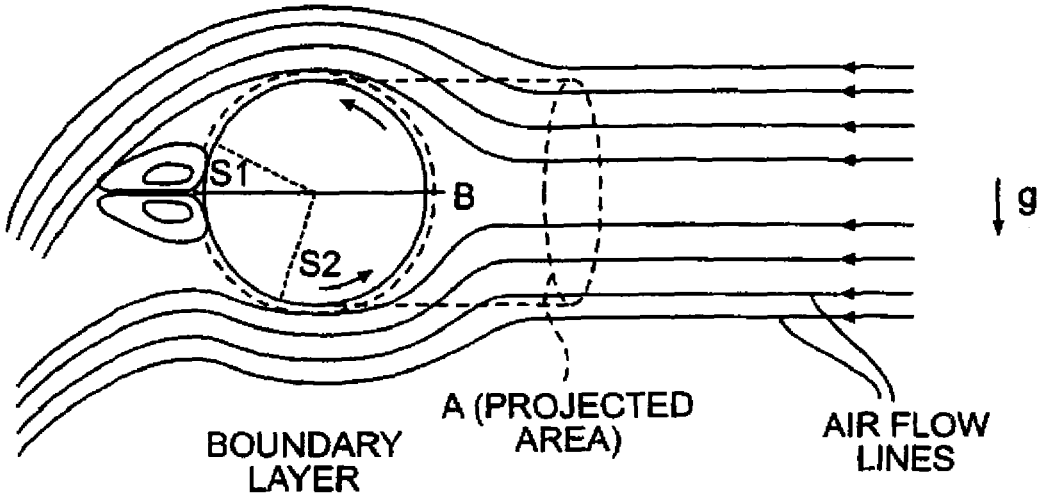
FIG. 1 is an illustration of the air flow on a golf ball in flight.

The distance that a golf ball will travel upon impact by a golf club is a function of the coefficient of restitution (COR), the weight, and the aerodynamic characteristics of the ball, which among other things are affected by one or more factors, such as the size, dimple coverage, dimple size and dimple shape. An embodiment of the present invention provides for a golf ball having a combination of low COR core and cover materials coupled with a less aerodynamic dimple pattern that achieves a reduction in carry and overall distance of 15 and 25 yards versus a conventional golf ball, while still providing the look, sound, feel and trajectory shape of a conventional golf ball. In various embodiments of the present invention, a high performance golf ball having a reduced distance is achieved via a combination of increased coefficient of drag, increased coefficient of lift, reduced weight, increased size, reduced compression, and/or decreased COR. Specific embodiments of the present invention have targeted spin rates, compressions, and coefficients of lift and drag. Additionally, embodiments of golf balls according to the present invention have greater distance reduction at high ball speeds, i.e., at high swing speeds, than at lower swing speeds.

Coefficient of Restitution: The COR is defined as the ratio of the relative velocity of two colliding objects after the collision to the relative velocity of the two colliding objects prior to the collision. For golf balls, the COR is measured by propelling it into a very massive steel block. This simplifies the measurement, because the velocity of the block is zero before the collision and essentially zero after the collision. Thus, the COR becomes the ratio of the velocity of the golf ball after impact to the velocity of the golf ball prior to impact, and it varies from 0 to 1.0. A COR value of 1.0 is equivalent to a perfectly elastic collision, and a COR value of 0.0 is equivalent to a perfectly inelastic collision. The COR is related to the initial velocity of the ball that must not exceed 250 ft/s (plus a 5 ft/s tolerance), the maximum limit set forth by the USGA. Hence, the COR of golf balls are maximized and controlled, so that the initial velocity of the ball does not exceed the USGA limit. The COR of the golf ball is affected by a number of factors including the composition of the core and the composition of the cover.

In one embodiment, a golf ball prepared according to the present invention has a "low" COR of typically less than about 0.790, preferably about 0.500 to about 0.790, more preferably about 0.550 to about 0.785, and most preferably about 0.600 to about 0.780.

Compression: Compression is an important factor in golf ball design, e.g. the compression of the core influences the ball's spin rate off the driver and the feel of the ball. Compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. Using the Atti Compression tester, a total of 0.2 inches of deflection is applied to both the spring within the Federal gauge and the ball. The amount of deflection of the ball relative to the spring in the gauge determines the ball's compression reading. If the gauge spring is deflected 0.1" and the ball is deflected 0.1", then the ball reads as a "100 compression". If the ball is deflected 0.11" and the gauge is deflected 0.90", the ball is a 90 compression (the reading on the dial gauge of the spring deflects less, as the ball is softer and deflects more, as the ball is harder). Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

$$(\text{Atti or PGA compression})=(160-\text{Riehle Compression}).$$

The PGA compression of golf balls prepared according to the invention is typically less than 100 as measured on a sphere, preferably between about 80 to about 99, more preferably between about 86 to about 94.

Figure 2:
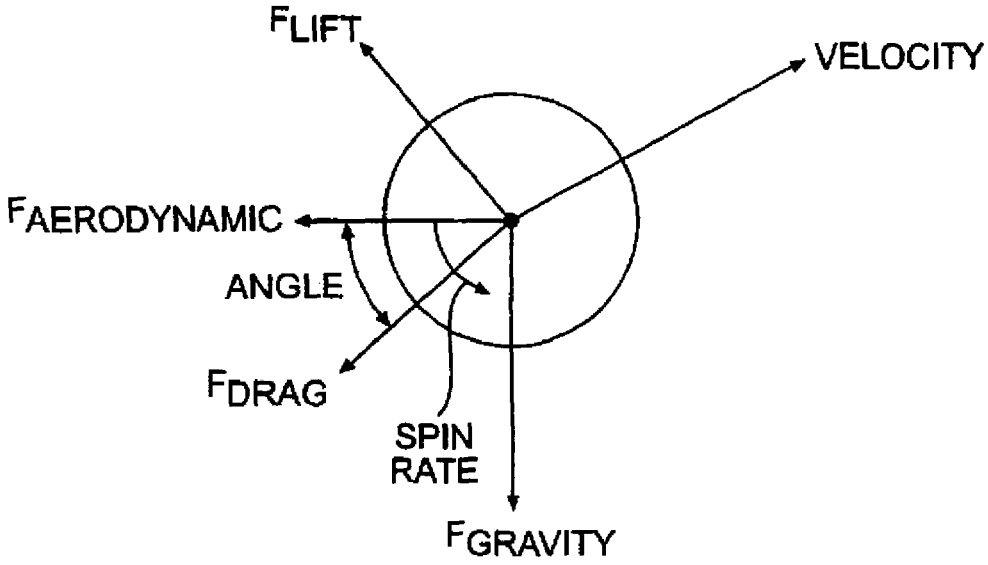
FIG. 2 is an illustration of the forces acting on a golf ball in flight.

Aerodynamic Characteristics: The aerodynamic forces acting on a golf ball in flight are enumerated in Equation 1 and illustrated in FIG. 2:

$$F=F_L+F_D+F_G \quad \text{(Eq. 1)}$$

where F=total force acting on the ball; $F_L$=lift force; $F_D$=drag force; and $F_G$=gravity force. The lift force ($F_L$) is the component of the aerodynamic force acting in a direction dictated by the cross product of the spin vector and the velocity vector. The drag force ($F_D$) is the component of the aerodynamic force acting in a direction that is directly opposite the velocity vector. The lift and drag forces of Equation 1 are calculated in Equations 2 and 3, respectively:

$$F_L=0.5C_L\rho AV^2 \quad \text{(Eq. 2)}$$

$$F_D=0.5C_D\rho AV^2 \quad \text{(Eq. 3)}$$

where ρ=density of air (slugs/ft$^3$); A=projected area of the ball (ft$^2$) ($(\pi/4)D^2$); D=ball diameter (ft); V=ball velocity (ft/s); $C_L$=dimensionless lift coefficient; and $C_D$=dimensionless drag coefficient.

Lift and drag coefficients are used to quantify the force imparted to a ball in flight and are dependent on air density, air viscosity, ball speed, and spin rate; the influence of all these parameters may be captured by two dimensionless parameters Spin Ratio (SR) and Reynolds Number ($N_{Re}$). Spin Ratio is the rotational surface speed of the ball divided by ball velocity. Reynolds Number quantifies the ratio of inertial to viscous forces acting on the golf ball moving through air. SR and $N_{Re}$ are calculated in Equations 4 and 5 below:

$$SR=\omega(D/2)/V \quad \text{(Eq. 4)}$$

$$N_{Re}=DV\rho/\mu \quad \text{(Eq. 5)}$$

where ω=ball rotation rate (radians/s) (2π/(RPS)); RPS=ball rotation rate (revolution/s); V=ball velocity (ft/s); D=ball diameter (ft); ρ=air density (slugs/ft$^3$); and μ=absolute viscosity of air (lb/ft$^2$-s).

There are a number of suitable methods for determining the lift and drag coefficients for a given range of spin rate and Reynolds number, which include the use of indoor test ranges with ballistic screen technology. U.S. Pat. No 5,682,230, the entire disclosure of which is incorporated by reference herein, teaches the use of a series of ballistic screens to acquire lift and drag coefficients. U.S. Pat. Nos. 6,186,002 and 6,285,445, also incorporated in their entirety by reference herein, disclose methods for determining lift and drag coefficients for a given range of velocities and spin rates using an indoor test range, wherein the values for $C_L$ and $C_D$ are related to spin rates and Reynolds numbers for each shot. One skilled in the art of golf ball aerodynamics testing could readily determine the lift and drag coefficients through the use of an indoor test range.

Reduced distance golf balls prepared according to the present invention preferably have a relatively high coefficient of drag ($C_D$). In one embodiment, the $C_D$ is greater than 0.26 at a Reynolds number of 150000 and a spin rate of 3000 RPM, and greater than 0.29 at a Reynolds number of 120000 and a spin rate of 3000 RPM. Further, golf balls prepared according to the present invention may have a relatively high coefficient of lift ($C_L$). In one embodiment, the $C_L$ is greater than 0.21 at a Reynolds number of 150000 and a spin rate of 3000 RPM, and greater than 0.23 at a Reynolds number of 120000 and a spin rate of 3000 RPM.

In one embodiment, the present invention is directed to a golf ball having reduced flight distance while retaining the appearance of a normal trajectory that can be defined by two non-dimensional parameters that account for the lift, drag, size and weight of the ball. The coefficients are defined in Equations 6 and 7 below:

$$C_{D/W}=F_D/W \quad \text{(Eq. 6)}$$

$$C_{L/W}=F_L/W \quad \text{(Eq. 7)}$$

A reduction in flight distance is attainable when a golf ball's size, weight, dimple pattern and dimple profiles are selected to satisfy specific $C_{D/W}$ and $C_{L/W}$ criteria at specified combinations of Reynolds number and spin ratios (or spin rate), and the only other remaining variable is the COR. The size of the golf ball affects the lift and drag of the ball, since these forces are directly proportional to the surface area of the ball. The weight of the ball makes up the denominator of coefficients $C_{D/W}$ and $C_{L/W}$. Dimple patterns, e.g., percentage of dimple coverage and geodesic patterns, can increase or decrease aerodynamic efficiency. Dimple profiles, e.g., edge angle, entry angle and shape (circular, polygonal), can increase or decrease the lift and/or drag experienced by the ball. According to the present invention, these factors can be selected or combined to yield desired $C_{D/W}$ and/or $C_{L/W}$ for a reduced distance golf ball that retains the appearance of a high performance trajectory.

In Table 1A are the $C_{D/W}$ and/or $C_{D/W}$ for a long distance golf ball with a high performance trajectory that were derived from information in Table 1 of parent U.S. Pat. No. 6,729,976. Accordingly, a golf ball designed to have a $C_{D/W}$ and/or $C_{L/W}$ within the ranges of Table 1A at specified combinations of Reynolds number and spin ratios would characteristically exhibit a high performance trajectory with improved, i.e., longer flight distance.

TABLE 1A

AERODYNAMIC CHARACTERISTICS OF HIGH PERFORMANCE BALL
Ball Diameter = 1.68 inches, Ball Weight between 1.55-1.62 ounces

| | | $C_{L/W}=F_L/W$ | | $C_{D/W}=F_D/W$ | |
|---|---|---|---|---|---|
| $N_{RE}$ | SR | Low | High | Low | High |
| 230000 | 0.085 | 1.47 | 1.86 | 2.46 | 2.78 |
| 207000 | 0.095 | 1.35 | 1.69 | 2.00 | 2.26 |
| 184000 | 0.106 | 1.14 | 1.39 | 1.63 | 1.76 |
| 161000 | 0.122 | 0.95 | 1.17 | 1.26 | 1.34 |
| 138000 | 0.142 | 0.77 | 0.94 | 0.98 | 1.04 |
| 115000 | 0.170 | 0.61 | 0.74 | 0.73 | 0.80 |
| 92000 | 0.213 | 0.45 | 0.54 | 0.52 | 0.56 |
| 69000 | 0.284 | 0.27 | 0.34 | 0.33 | 0.37 |

In Table 1B are $C_{D/W}$ and/or $C_{L/W}$ for a reduced distance golf ball with a high performance trajectory that were derived by multiplying the coefficients of Table 1A by a distance reduction factor so that balls made to have the coefficients of Table 1B fly shorter while maintaining a similar-appearing trajectory to those of Table 1A. Suitable ranges for a distance reduction factor to achieve a golf ball in accordance with the present invention are 1.2 to 1.8, more preferably 1.4 to 1.6 and most preferably 1.5. Accordingly, one or both of the coefficients of Table 1B are then paired with COR of the core or the ball to yield a ball that flies 15-25 yards less than the USGA maximum. In one example, once $C_{D/W}$ and/or $C_{L/W}$ are set, the ball designer can vary COR to reach the distance objective, or vice versa. Table 1B lists suitable ranges of $C_{D/W}$ and $C_{L/W}$ at representative Reynolds number and spin ratios in accordance with the present invention.

TABLE 1B

AERODYNAMIC CHARACTERISTICS OF HIGH PERFORMANCE BALL HAVING A REDUCED DISTANCE
Ball Diameter = 1.68 inches, Ball Weight between 1.55-1.62 ounces

| | | $C_{L/W} = F_L/W$ | | | $C_{D/W} = F_D/W$ | | |
|---|---|---|---|---|---|---|---|
| $N_{RE}$ | SR | Low | Median | High | Low | Median | High |
| 230000 | 0.085 | 1.78 | 2.505 | 3.35 | 2.95 | 3.93 | 5.00 |
| 207000 | 0.095 | 1.62 | 2.285 | 3.04 | 2.40 | 3.195 | 4.07 |
| 184000 | 0.106 | 1.43 | 1.90 | 2.50 | 1.96 | 2.54 | 3.17 |
| 161000 | 0.122 | 1.14 | 1.35 | 2.11 | 1.51 | 1.950 | 2.41 |
| 138000 | 0.142 | 0.92 | 1.285 | 1.69 | 1.18 | 1.515 | 1.87 |
| 115000 | 0.170 | 0.73 | 1.012 | 1.33 | 0.88 | 1.147 | 1.44 |
| 92000 | 0.213 | 0.54 | 0.742 | 0.97 | 0.62 | 0.81 | 1.01 |
| 69000 | 0.284 | 0.32 | 0.458 | 0.61 | 0.40 | 0.525 | 0.66 |

Similarly in Table 1 C, a distance reduction factor was applied to $C_{D/W}$ and $C_{L/W}$ calculated for coefficients of lift and drag at specified Reynolds number and spin ratio as disclosed in U.S. Pat. No. 6,945,880 to arrive at suitable ranges of $C_{D/W}$ and $C_{L/W}$ at specified Reynolds number and spin ratios in accordance with the present invention.

TABLE 1C

AERODYNAMIC CHARACTERISTICS OF HIGH PERFORMANCE BALL HAVING A REDUCED DISTANCE
Ball Diameter = 1.68 inches, Ball Weight 1.62 ounces

| | | $C_{L/W} = F_L/W$ | | | $C_{D/W} = F_D/W$ | | |
|---|---|---|---|---|---|---|---|
| $N_{RE}$ | SR | Low | Median | High | Low | Median | High |
| 180000 | 0.110 | 1.38 | 1.845 | 2.36 | 0.36 | 0.465 | 0.58 |
| 70000 | 0.188 | 0.28 | 0.375 | 0.49 | 2.40 | 3.195 | 4.07 |

In accordance to the present invention, a golf ball designer first chooses the range of $C_{D/W}$ and/or $C_{L/W}$ corresponding to the desired reduction in total distance after impact. Next, a dimple pattern is selected. The ball then can be fine tuned with varying dimple coverage and/or dimple edge angle. Alternatively, the dimple coverage (or dimple edge angle) can be selected prior to fine tuning the dimple edge angle and/ or dimple pattern.

Dimple Patterns: As discussed briefly above, one way of adjusting the drag on, and correspondingly affecting the lift of, a golf ball is through different dimple patterns and profiles. Dimples on a golf ball create a turbulent boundary layer around the ball, i.e., the air in a thin layer adjacent to the ball flows in a turbulent manner. The turbulence energizes the boundary layer and helps it remain attached further around the ball to reduce the area of the wake. This greatly increases the average pressure behind the ball to reduce the pressure differential forward and aft of the ball, thereby substantially reducing the drag. Accordingly, a golf ball's dimple patterns, shapes, quantity and/or dimensions may be manipulated to achieve variances in the drag experienced by the ball during flight. In various embodiments of the present invention, a golf ball's dimple pattern, shape, quantity and/or dimension may be selected to "increase" drag on the ball without adversely affecting the ball's trajectory to achieve a reduction in overall flight distance.

As used herein, the term "dimple", may include any texturizing on the surface of a golf ball, e.g., depressions and projections. Some non-limiting examples of depressions and projections include, but are not limited to, spherical depressions, meshes, raised ridges, and brambles. The depressions and projections may take a variety of planform shapes, such as circular, polygonal, oval, or irregular. Dimples that have multi-level configurations, i.e., dimple within a dimple, are also contemplated by the invention to obtain desirable aerodynamic characteristics.

In one embodiment, a textured clear coating may be applied to the outer surface of the golf ball to increase the skin friction of the ball, e.g., friction caused by surface roughness. Higher skin friction increases drag on the ball to reduce flight distance.

In a preferred embodiment, a golf ball having a low COR and a low coverage dimple pattern with dimples having a high edge angle is found to reduce the distance the ball travels by 15 to 30 yards versus a similar conventional golf ball. A low coverage dimple pattern according to this embodiment is dimple coverage of about 55% to 75%, preferably dimple coverage of about 60% to 70%, and more preferably dimple coverage of about 65%. A high edge angle according to this embodiment is a dimple edge angle of from about 16 to 24 degrees, preferably from about 18 to 22 degrees, and more preferably about 20 degrees. More particularly, a low coverage dimple pattern according to this embodiment of the present invention includes a 440 dimple cuboctahedron pattern, as described in U.S. Pat. No. 4,948,143 to Aoyama, which is incorporated by reference herein in its entirety, wherein the dimple coverage is about 70% and the dimple edge angle is between about 18° to about 22°.

Dimple patterns that provide a high percentage of surface coverage are well-known in the art. For example, U.S. Pat. Nos. 5,562,552; 5,575,477; 5,957,787; 5,249,804; and 4,925,193 the entire disclosures of which are incorporated by reference herein, disclose geometric patterns for positioning dimples on a golf ball. A low coverage, high edge angle dimple pattern that performs according to the present invention may be achieved using any one of the dimple patterns disclosed in the aforementioned patents by reducing dimple coverage to about 60% to about 70% and increasing the dimple edge angle to about 16°, 18°, 20° and/or 22°. In one example, the desired reduction in dimple coverage is achieved by reducing the dimple diameters by the same or different amounts. Without being tied to a particular theory, this unexpected result may be attributed to an excessive amount of turbulence being generated by the greater edge angle of each dimple, with a corresponding increase in the drag on the ball.

Figure 3:
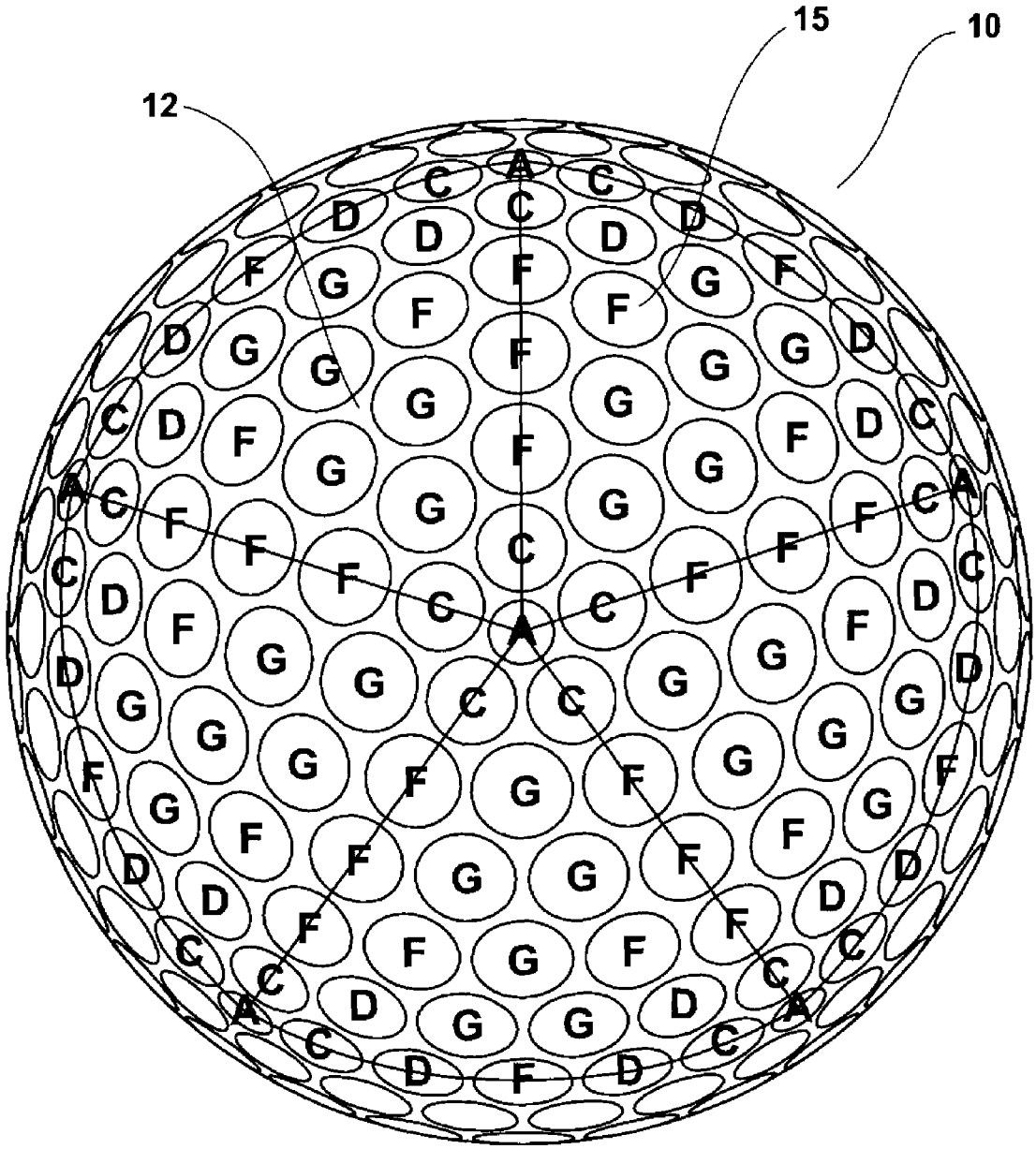
FIG. 3 is a top or polar view of an embodiment of the present invention.
Figure 3A:
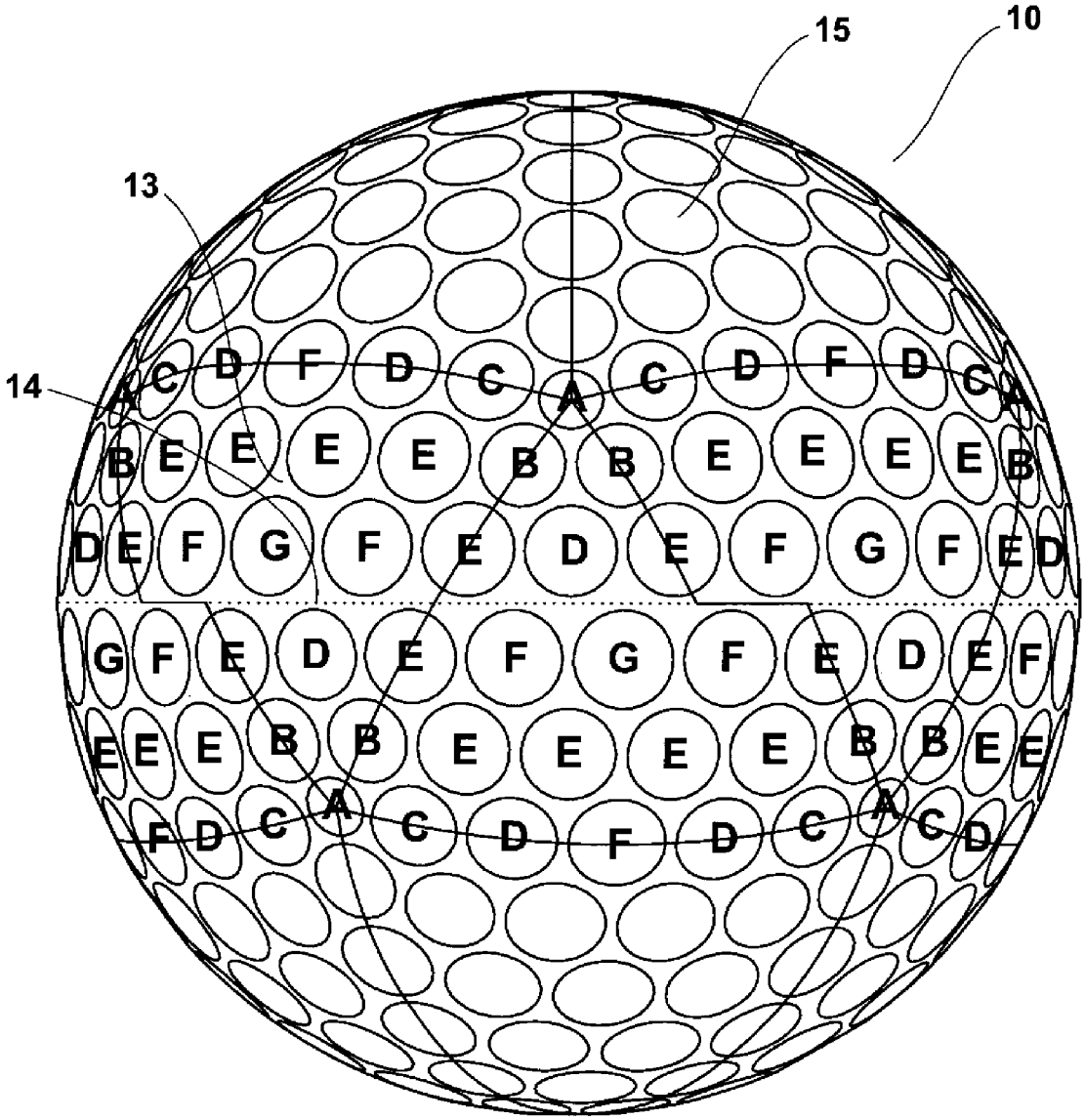
FIG. 3A is a side or equatorial view of an embodiment of the present invention.

As shown in FIGS. 3 and 3A and in accordance to an embodiment of the present invention, a golf ball 10 comprises a plurality of dimples 15 arranged in an icosahedron pattern. This dimple pattern has a reduced dimple coverage. The edge angle of these dimples is preferably in the range of 18° to 22°. Generally, an icosahedron pattern comprises twenty triangles with five triangles 12 sharing a common vertex coinciding with each pole, and ten triangles 13 disposed in the equatorial region between the two five-triangle polar regions. Usually, as in this case, the ten equatorial triangles 13 are modified somewhat to provide an equator 14 that does not intersect any dimples. The equator can then be used as the mold parting line. FIG. 3A is a side view of the ball showing these modified equatorial triangles 13. In unmodified form, a row of dimples would have existed directly on the equator 14. This row was removed, and other dimples were shifted and resized to fill the resulting space. This also created a "jog" in one side of the triangle. Other suitable dimple patterns include dodecahedron, octahedron, hexahedron and tetrahedron, among others. The dimple pattern may also be defined at least partially by phyllotaxis-based patterns, such as those described in U.S. Pat. No. 6,338,684.

This embodiment comprises seven different sized dimples, as shown in Table A below:

TABLE A

| Dimples and Dimple Pattern | | | |
|---|---|---|---|
| Dimple | Diameter (inch) | Number of Dimples | Surface Coverage % |
| A | .105 | 12 | 1.2 |
| B | .141 | 20 | 3.5 |
| C | .146 | 40 | 7.6 |
| D | .150 | 50 | 10.0 |
| E | .155 | 60 | 12.8 |
| F | .160 | 80 | 18.2 |
| G | .164 | 70 | 16.7 |
| Total | | 332 | 70.0% |

These dimples form ten polar triangles 12, with the smallest dimples A occupying the vertices and the largest dimples G occupying most of the interior of the triangle. Three dimples F and two dimples C symmetrically form two sides of the triangle, and a symmetrical arrangement of one dimple F, two dimples D and two dimples C form the remaining side of the triangle, as shown in FIG. 3. In addition, the dimples form ten equatorial triangles 13 which share their vertex dimples A and one of their sides with the ten polar triangles 12. Two dimples E and two dimples B symmetrically form the remaining sides, as shown in FIG. 3A.

Figure 4:
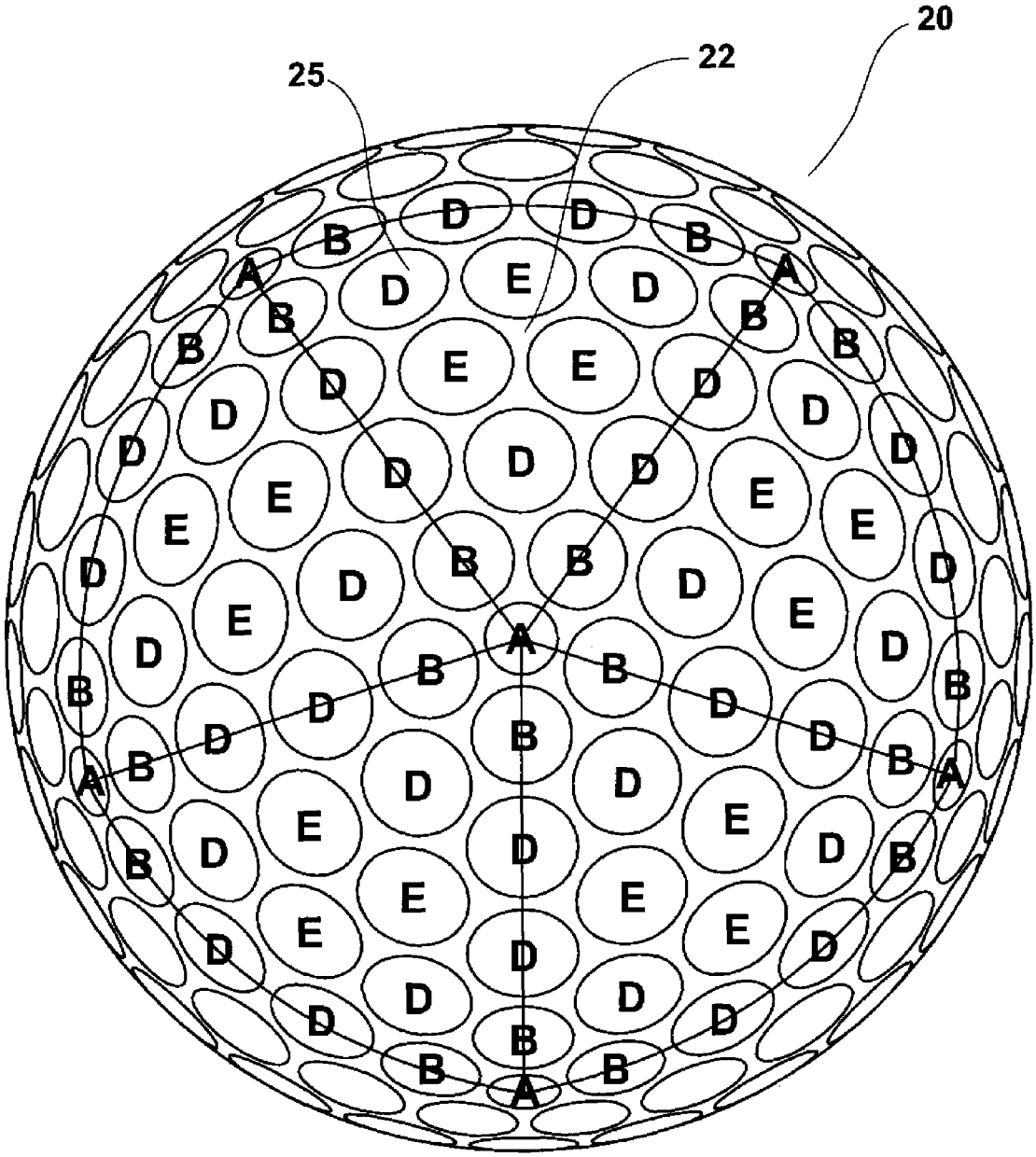
FIG. 4 is a top or polar view of another embodiment of the present invention.

Another embodiment of the present invention shown in FIG. 4 comprises fewer and larger dimples. This embodiment comprises six different sized dimples, as shown in Table B below

TABLE B

| Dimples and Dimple Pattern | | | |
|---|---|---|---|
| Dimple | Diameter (inch) | Number of Dimples | Surface Coverage % |
| A | .118 | 12 | 1.5 |
| B | .163 | 60 | 14.2 |
| C | .177 | 10 | 2.8 |
| D | .182 | 90 | 26.5 |
| E | .186 | 50 | 15.4 |
| F | .191 | 30 | 9.7 |
| Total | | 252 | 70.0% |

Figure 4A:
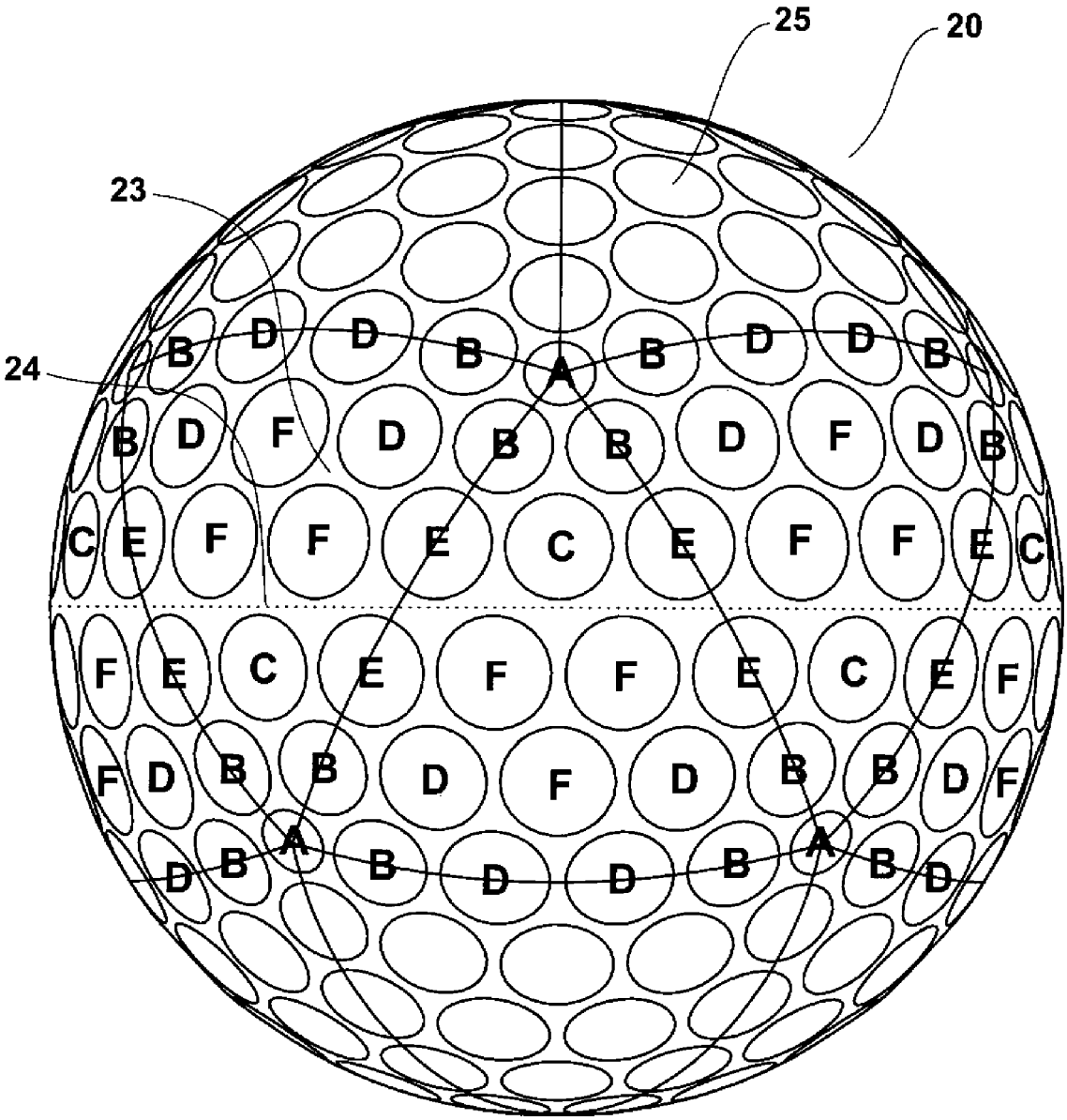
FIG. 4A is a side or equatorial view of another embodiment of the present invention.

As shown in FIG. 4, golf ball 20 comprises a plurality of dimples 25 arranged into an icosahedron pattern. Ball 20 comprises ten polar triangles 22 with smallest dimples A occupying the vertices of the triangle. Each side of polar triangle 22 is a symmetrical arrangement of two dimples D and two dimples B. The interior of triangle 22 comprises three dimples D and three dimples E. As shown in FIG. 4A, the dimple arrangement further comprises ten equatorial triangles 23. However, in this embodiment only minor adjustments in dimples size and position were required in order to provide a dimple-free equator 24, and no dimples were removed. Thus, the equatorial triangles 23 are quite similar to the polar triangles 22, and they do not have a "jog" in one of their sides.

In a further embodiment, a golf ball having a low COR includes a high coverage dimple pattern, i.e., greater than 80%, with the same dimple arrangement as shown in FIG. 3 but with larger dimples that results in an increase in drag on the ball as long as the edge angle of the dimples remains high, i.e., between 16°-21°.

Ball Construction: According to the Rules of Golf as approved by the USGA, a golf ball may not have a weight in excess of 1.620 ounces (45.93 g) or a diameter of less than 1.680 inches (42.67 mm). Accordingly, a golf ball having a weight of 45.93 g and/or a diameter of 42.67 mm inches is within the purview of this invention. However, the USGA rules do not set a minimum weight or a maximum diameter for the ball. These specifications, along with other USGA golf ball requirements, are intended to limit how far a golf ball will travel when hit. When all other parameters are maintained, an increase in the weight of the ball tends to increase the distance it will travel and lower the trajectory, as a ball having greater momentum is better able to overcome drag and a reduction in the diameter of the ball will also have the effect of increasing the distance it will travel, as a smaller ball has a smaller projected area and correspondingly less drag.

In accordance with the present invention, a golf ball having a decreased weight and/or an increased diameter may be made to decrease the overall distance a ball travels at a given swing speed while maintaining a high performance trajectory during flight. Accordingly, the diameter of "oversized" golf balls prepared according to the present invention is preferably about 1.688 to about 1.800 inches, more preferably about 1.690 to about 1.740 inches and most preferably about 1.695 to about 1.725 inches. The weight of "low-weight" golf balls prepared according to the present invention is preferably about 1.39 to about 1.61 ounces, and more preferably about 1.45 to about 1.58 ounces.

Various embodiments of the present invention may be practiced using a suitable ball construction as would be apparent to one of ordinary skill in the art. For example, the ball may have a one-piece design, a two-piece design, a three-piece design, a double core, a double cover, or multi-core and multi-cover construction depending on the type of performance desired of the ball. Further, the core may be solid, liquid filled, hollow, and/or non-spherical. It may also be wound or foamed, or it may contain fillers. Foamed cores are generally known to have lower COR. The cover may also be a single layer cover or a multi-layer cover. The cover may be thin or thick. The cover may have a high hardness or low hardness to control the spin and feel of the ball. The cover may comprise a thermoplastic or a thermoset material, or both. In one preferred embodiment, the golf ball has a relatively thick cover, e.g., up to about 0.100 inch, made from a thermoplastic ionomer or other low resilient polymers. A ball with a thick low-resilient cover would have a lower COR than a similar ball with a thin low-resilient cover.

Non-limiting examples of the aforementioned ball constructions, compositions and dimensions of the cover and core that may be used with the present invention include those described in U.S. Pat. Nos. 6,419,535, 6,152,834, 6,149,535, 5,981,654, 5,981,658, 5,965,669, 5,919,100, 5,885,172, 5,813,923, 5,803,831, 5,783,293, 5,713,801, 5,692,974, and 5,688,191, as well as in U.S. Publ. Appl. No. US 2001/0009310 A1 and WIPO Publ. Appl. Nos. WO 00/29129 and WO 00/23519. The entire disclosures of these patents and published applications are incorporated by reference herein. The construction, materials and dimensions of the core and cover contribute to achieving the requisite COR of a golf ball according to the present invention.

Suitable polymers for manufacturing the core of a golf ball according to the present invention include a low resilient elastomer, such as butyl rubber. Butyl rubber has the ability to dissipate the impact energy from golf clubs to attenuate the rebound energy available for ball propulsion. Resiliency of rubber is a physical property of rubber that returns it to its original shape after deformation, without exceeding its elastic limit. For instance, the resilience of butyl rubber as measured on a Bashore resiliometer is in the range of 18% to 25%, as compared to cis-polybutadiene rubber, which is in the range of 85%-90% when they are cross-linked using appropriate cross-linking agents.

Butyl rubber (IIR) is an elastomeric copolymer of isobutylene and isoprene. Detailed discussions of butyl rubber are provided in U.S. Pat. Nos. 3,642,728, 2,356,128 and 3,099,644, the entire disclosures of which are incorporated by reference herein. Butyl rubber is an amorphous, non-polar polymer with good oxidative and thermal stability, good permanent flexibility and high moisture and gas resistance. Generally, butyl rubber includes copolymers of about 70% to 99.5% by weight of an isoolefin, which has about 4 to 7 carbon atoms, e.g., isobutylene, and about 0.5% to 30% by weight of a conjugated multiolefin, which has about 4 to 14 carbon atoms, e.g., isoprene. The resulting copolymer contains about 85% to about 99.8% by weight of combined isoolefin and 0.2% to 15% of combined multiolefin. A commercially available butyl rubber includes Bayer Butyl 301 manufactured by Bayer AG.

Butyl rubber is also available in halogenated form. A halogenated butyl rubber may be prepared by halogenating butyl rubber in a solution containing inert C3-C5 hydrocarbon solvent, such as pentane, hexane or heptane, and contacting this solution with a halogen gas for a predetermined amount of time, whereby halogenated butyl rubber and a hydrogen halide are formed. The halogenated butyl rubber copolymer may contain up to one halogen atom per double bond. Halogenated butyl rubbers or halobutyl rubbers include bromobutyl rubber, which may contain up to 3% reactive bromine, and chlorobutyl rubber, which may contain up to 3% reactive chlorine. Halogenated butyl rubbers are also available from ExxonMobil Chemical.

Butyl rubber is also available in sulfonated form, such as those disclosed in the '728 patent and in U.S. Pat. No.4,229,337. Generally, butyl rubber having a viscosity average molecular weight in the range of about 5,000 to 85,000 and a mole percent unsaturation of about 3% to about 4% may be sulfonated with a sulfonating agent comprising a sulfur trioxide ($SO_3$) donor in combination with a Lewis base containing oxygen, nitrogen or phosphorus. The Lewis base serves as a complexing agent for the $SO_3$ donor. $SO_3$ donor includes compound containing available $SO_3$, such as chlorosulfonic acid, fluorosulfonic acid, sulfuric acid and oleum.

Other suitable polymers include the elastomers that combine butyl rubbers with the environmental and aging resistance of ethylene propylene diene monomer rubbers (EPDM), commercially available as Exxpro™ from ExxonMobil Chemical. More specifically, these elastomers are brominated polymers derived from a copolymer of isobutylene (IB) and p-methylstyrene (PMS). Bromination selectively occurs on the PMS methyl group to provide a reactive benzylic bromine functionality. Another suitable velocity-reduced polymer is copolymer of isobulyline and isoprene with a styrene block copolymer branching agent to improve manufacturing processability.

Another suitable low resilient polymer is polyisobutylene. Polyisobutylene is a homopolymer, which is produced by cationic polymerization methods. Commercially available grades of polyisobutylene, under the tradename Vistanex™ also from ExxonMobil Chemical, are highly paraffinic hydrocarbon polymers composed on long straight chain molecules containing only chain-end olefinic bonds. An advantage of such elastomer is the combination of low rebound energy and chemical inertness to resist chemical or oxidative attacks. Polyisobutylene is available as a viscous liquid or semi-solids, and can be dissolved in certain hydrocarbon solvents.

Butyl rubbers can be cured by a number of curing agents, preferably a peroxide curing agent. Other suitable curing agents may include antimony oxide, lead oxide or lead peroxide. Lead based curing agents may be used when appropriate safety precautions are implemented. Butyl rubbers are commercially available in various grades from viscous liquid to solids with varying the degree of unsaturation and molecular weights.

In an embodiment, a golf ball core prepared in accordance with the present invention includes 15-50 parts butyl rubber to 50-85 parts polybutadiene to make up 100 parts of rubber (phr), cross-linking agents and other additives, such that it has a low COR of between about 0.550 and about 0.650. The polybutadiene preferably has a high cis 1,4 content of above about 85% and more preferably above about 95%. Commercial sources for polybutadiene include Shell 1220 manufactured by Shell Chemical and CB-23 manufactured by Bayer AG. In a further embodiment, a golf ball core prepared in accordance with the present invention includes 25 parts butyl rubber to 75 parts polybutadiene to achieve a COR of about 0.650 to about 0.750.

Tables 2-5 show characteristics of various embodiments of relatively lower COR cores made from compositions of butyl rubber or halogenated butyl rubbers mixed with polybutadiene rubber (Shell 1220) in accordance with the present invention. ZDA is utilized as a co-reaction agent, with the addition of di-tert-butyl peroxide (DTBP) or dicumyl peroxide. A core comprised of Shell 1220 polybutadiene is used as a control.

TABLE 2

REDUCED-DISTANCE GOLF BALLS WITH LOW COR CORE

| Core Compositions (27 pph ZDA - Trigonox 65) | Size (in) | Weight (g) | Comp. (Atti) | COR | S.G. |
|---|---|---|---|---|---|
| 75 PBD/ 25 Butyl rubber (Butyl 301) | 1.539 | 37.63 | 110 | 0.720 | 1.140 |
| 75 PBD/ 25 HALOGENATED BUTYL RUBBER (Bromo 2030) | 1.543 | 37.09 | 98 | 0.717 | 1.140 |
| 75 PBD/ 25 HALOGENATED BUTYL RUBBER (Bromo 2040) | 1.541 | 37.12 | 109 | 0.724 | 1.140 |
| 75 PBD/ 25 HALOGENATED BUTYL RUBBER (Chloro 1240) | 1.537 | 37.38 | 112 | 0.724 | 1.140 |
| 100 PBD (control) | 1.544 | 37.51 | 97 | 0.781 | 1.140 |

TABLE 3

REDUCED-DISTANCE GOLF BALLS WITH LOW COR CORE

| Core Compositions (20 pph ZDA - Trigonox 65) | Size (in) | Weight (g) | Comp. (Atti) | COR | S.G. |
|---|---|---|---|---|---|
| 75 PBD/ 25 Butyl rubber (Butyl 301) | 1.558 | 37.42 | 58 | 0.668 | 1.130 |
| 75 PBD/ 25 HALOGENATED BUTYL RUBBER (Bromo 2030) | 1.557 | 37.65 | 62 | 0.673 | 1.130 |
| 75 PBD/ 25 HALOGENATED BUTYL RUBBER (Bromo 2040) | 1.558 | 37.58 | 56 | 0.677 | 1.130 |

TABLE 3-continued

| REDUCED-DISTANCE GOLF BALLS WITH LOW COR CORE | | | | | |
|---|---|---|---|---|---|
| Core Compositions (20 pph ZDA - Trigonox 65) | Size (in) | Weight (g) | Comp. (Atti) | COR | S.G. |
| 75 PBD/ 25 HALOGENATED BUTYL RUBBER (Chloro 1240) | 1.557 | 37.72 | 62 | 0.677 | 1.130 |
| 100 PBD (control) | 1.560 | 37.87 | 50 | 0.774 | 1.130 |

TABLE 4

| REDUCED-DISTANCE GOLF BALLS WITH LOW COR CORE | | | | | |
|---|---|---|---|---|---|
| Core Compositions (20 pph ZDA - Dicumyl Peroxide) | Size (in) | Weight (g) | Comp. (Atti) | COR | S.G. |
| 75 PBD/ 25 Butyl rubber (Butyl 301) | 1.546 | 37.34 | 68 | 0.669 | 1.130 |
| 75 PBD/ 25 HALOGENATED BUTYL RUBBER (Bromo 2030) | 1.545 | 37.13 | 75 | 0.678 | 1.130 |
| 75 PBD/ 25 HALOGENATED BUTYL RUBBER (Bromo 2040) | 1.548 | 37.25 | 68 | 0.673 | 1.130 |
| 75 PBD/ 25 HALOGENATED BUTYL RUBBER (Chloro 1240) | 1.547 | 37.39 | 75 | 0.680 | 1.130 |
| 100 PBD (control) | 1.547 | 37.25 | 58 | 0.773 | 1.130 |

TABLE 5

| REDUCED-DISTANCE GOLF BALLS WITH LOW COR CORE | | | | | |
|---|---|---|---|---|---|
| Core Compositions (20 pph ZDA - Dicumyl Peroxide) | Size (in) | Weight (g) | Comp. (Atti) | COR | S.G. |
| 85 PBD/ 15 Butyl rubber (Butyl 301) | 1.546 | 37.41 | 69 | 0.708 | 1.130 |

TABLE 5-continued

| REDUCED-DISTANCE GOLF BALLS WITH LOW COR CORE | | | | | |
|---|---|---|---|---|---|
| Core Compositions (20 pph ZDA - Dicumyl Peroxide) | Size (in) | Weight (g) | Comp. (Atti) | COR | S.G. |
| 85 PBD/ 15 HALOGENATED BUTYL RUBBER (Bromo 2030) | 1.546 | 37.36 | 72 | 0.719 | 1.130 |
| 85 PBD/ 15 HALOGENATED BUTYL RUBBER (Bromo 2040) | 1.542 | 37.29 | 79 | 0.717 | 1.130 |
| 85 PBD/ 15 HALOGENATED BUTYL RUBBER (Chloro 1240) | 1.546 | 37.18 | 70 | 0.714 | 1.130 |
| 100 PBD (control) | 1.547 | 37.25 | 63 | 0.771 | 1.130 |

The cores shown in Tables 2-4 have similar rubber contents. The cores from Tables 2 and 3 have different amounts of co-reaction agent ZDA and the results show a lower amount of co-reaction agent tends to reduce COR. The cores from Table 3 and 4 used the same amount but different type of co-reaction agent ZDA. The results show that the CORs for the cores stay substantially the same. The cores from Table 5 have less of the low resilient butyl rubber than the cores from Table 4. The results show that cores with less of the low resilient rubber have higher COR, as expected.

Table 6 shows the characteristics of low compression golf balls A-D according to another embodiment of the present invention. Golf balls A-D have generally lower compression than the Pinnacle® Practice ball, Pinnacle Gold® Distance ball and Pro V1® balls. Golfballs A-D also have COR values below those of the Pinnacle® Practice ball, Pinnacle Gold® Distance ball and Pro V1® balls. These low compression, low COR balls can be used in combination with the lower aerodynamic factors discussed above to produce balls in accordance with the present invention.

TABLE 6

| REDUCED DISTANCE LOW COMPRESSION GOLF BALLS HAVING LOWER COR | | | | | | | |
|---|---|---|---|---|---|---|---|
| Ball | Core (in) | Cover (ionomer blends)* | Size (in) | Weight (oz) | Comp (Atti) | COR | Shore C/D |
| A | 1.550-65 | 8528/9650 | 1.688 | 1.612 | 79.1 | 0.763 | 90.3/59.8 |
| B | 1.550-65 | 8528/9910 | 1.691 | 1.614 | 79.9 | 0.767 | 91.2/60.6 |
| C | 1.550-70 | 8528/9650 | 1.681 | 1.607 | 83.9 | 0.770 | 89.6/58.8 |
| D | 1.550-70 | 8528/9910 | 1.688 | 1.613 | 85.5 | 0.772 | 91/60.6 |
| Pinnacle ® Practice | Production | Production | 1.684 | 1.601 | 100.2 | 0.799 | 83.8/54.8 |
| Pinnacle Gold ® Distance | Production | Production | 1.689 | 1.607 | 86.6 | 0.810 | 94.8/66.4 |
| Pro V1 ® | Production | Production | 1.686 | 1.608 | 83.6 | 0.814 | 79/55.7 |

*Numbers indicate the Surlyn ® ionomer blend used.

Table 7 shows the characteristics of low COR golf balls according to the present invention having a core with 25%, 50% and 75% styrene butadiene rubber (SBR), another low resilient rubber similar to butyl rubber discussed above. The remaining rubber component is high-cis polybutadiene, similar to above. The rubber components are cross-linked with 20-32 parts of ZDA co-reaction agent. The SBR golf balls have COR values below that of the control ball, i.e., a two-piece distance golf ball.

TABLE 7

REDUCED DISTANCE GOLF BALLS WITH LOW COR SBR CORE COMPOSITIONS

| Ball Core | Size (mm) - Pole | Size (mm) - Equator | Weight (gm) | Comp (Atti) | COR | Shore C/D |
|---|---|---|---|---|---|---|
| 25 SBR 75 PBD | 44 | 44 | 36.14 | 73 | 0.776 | |
| 50 SBR 50 PBD | 45 | 44 | 36.34 | 72 | 0.744 | |
| 75 SBR 25 PBD | 42 | 45 | 36.38 | 79 | 0.709 | |
| Control | 44 | 46 | 36.05 | 73 | 0.805 | |

Again the reduced COR cores shown in Table 7 can be combined with the D/W and L/W variables discussed above to produce balls in accordance with the present invention.

In Tables 8A-8C below are core compositions and core/ball physical properties for low weight and/or low COR cores and golf balls (2)-(8). Golf Balls (1)-(8) are of a three-piece ball construction having a core dimension of about 1.53 inches, a core and casing dimension of about 1.62 inches, and a finished ball dimension (core, casing, cover) of about 1.68 inches. Each of golf balls (1)-(8) includes a casing or inner cover composed of an ionomer blend, for example Surlyn. The cover for each ball is a cast aromatic urethane with a 392 Icosahedron dimple pattern. The casing and cover for balls (1)-(8) are similar to that of a premium multi-layer golf ball.

In this embodiment, cores having three different weights and various compositions (see Table 8A) are compared to each other. With reference to Table 8A, the "normal" weight cores include a high specific gravity filler to provide the ball with the maximum 1.62 oz USGA weight. A barium sulfate filler with a 4.2 s.g. and 325 mesh size (available as Polywate 325) is added to the normal cores. The ~1.510 oz weight cores do not contain high specific gravity fillers. The ~1.40 oz. weight balls have hollow microspheres incorporated therein to further reduce the weight of the cores. In selected cores, a low-resilient butyl rubber makes up a portion of the rubber component.

TABLE 8A

COMPOSITIONS OF CORES (2)-(8) FOR REDUCED DISTANCE GOLF BALLS

| | Ball Core | | | | | | | |
|---|---|---|---|---|---|---|---|---|
| Constituent | (1) Norm. Wgt Norm. COR phr | (2) Norm. Wgt 0.700 COR phr | (3) Norm. Wgt 0.650 COR phr | (4) Min. Wgt 0.700 COR phr | (5) Min. Wgt 0.650 COR phr | (6) Lgt Wgt 0.700 COR phr | (7) Lgt Wgt 0.650 COR phr | (8) Lgt Wgt Norm. COR phr |
| Halogenated butyl rubber | 0 | 26 | 40 | 30 | 44 | 26 | 40 | 0 |
| PBD (CB 23) | 100 | 0 | 0 | 0 | 0 | 0 | 0 | 100 |
| PBD (Shell 1220) | 0 | 74 | 60 | 70 | 56 | 74 | 60 | 0 |
| ZDA Powder | 26 | 23 | 22 | 24 | 25 | 16.5 | 17 | 24 |
| Zinc Oxide | 5 | 5 | 5 | 5 | 5 | 5 | 5 | 5 |
| ZnPCTP | 0 | 0 | 0 | 0 | 0 | 0 | 0 | 0.5 |
| microsphere | 0 | 0 | 0 | 0 | 0 | 15.5 | 18 | 25.5 |
| Dicumyl Peroxide (Perkadox BC) | 1.3 | 1.3 | 1.3 | 1.3 | 1.3 | 1.3 | 1.3 | 0.8 |
| Barium sulfate (Polywate 325) | 16.8 | 18.1 | 18.4 | 0 | 0 | 0 | 0 | 0 |

TABLE 8B

PHYSICAL PROPERTIES OF CORES (2)-(8) FOR REDUCED DISTANCE GOLF BALLS

| Ball Core | Size (in) | Weight (oz) | Compression | COR |
|---|---|---|---|---|
| Control (1) | 1.528 | 1.270 | 67 | 0.790 |
| (2) | 1.529 | 1.268 | 72 | 0.683 |
| (3) | 1.525 | 1.264 | 78 | 0.622 |
| (4) | 1.531 | 1.161 | 68 | 0.672 |
| (5) | 1.529 | 1.159 | 68 | 0.595 |
| (6) | 1.527 | 1.046 | 64 | 0.661 |
| (7) | 1.526 | 1.039 | 69 | 0.596 |
| (8) | 1.527 | 1.027 | 77 | 0.799 |

TABLE 8C

PHYSICAL PROPERTIES OF REDUCED DISTANCE GOLF BALLS (2)-(8)

| Finished Ball | Size (in) | Weight (oz) | Compression | COR | Shore C |
|---|---|---|---|---|---|
| Control (1) | 1.683 | 1.618 | 90 | 0.796 | 82 |
| (2) | 1.683 | 1.619 | 93 | 0.704 | 81 |
| (3) | 1.684 | 1.620 | 99 | 0.649 | 81 |
| (4) | 1.684 | 1.511 | 90 | 0.696 | 81 |
| (5) | 1.683 | 1.513 | 89 | 0.635 | 81 |
| (6) | 1.683 | 1.405 | 86 | 0.689 | 81 |
| (7) | 1.683 | 1.399 | 92 | 0.631 | 82 |
| (8) | 1.683 | 1.386 | 97 | 0.801 | 81 |
| Pro V1 ® | 1.683 | 1.609 | 96 | 0.807 | 81 |

Figure 5:
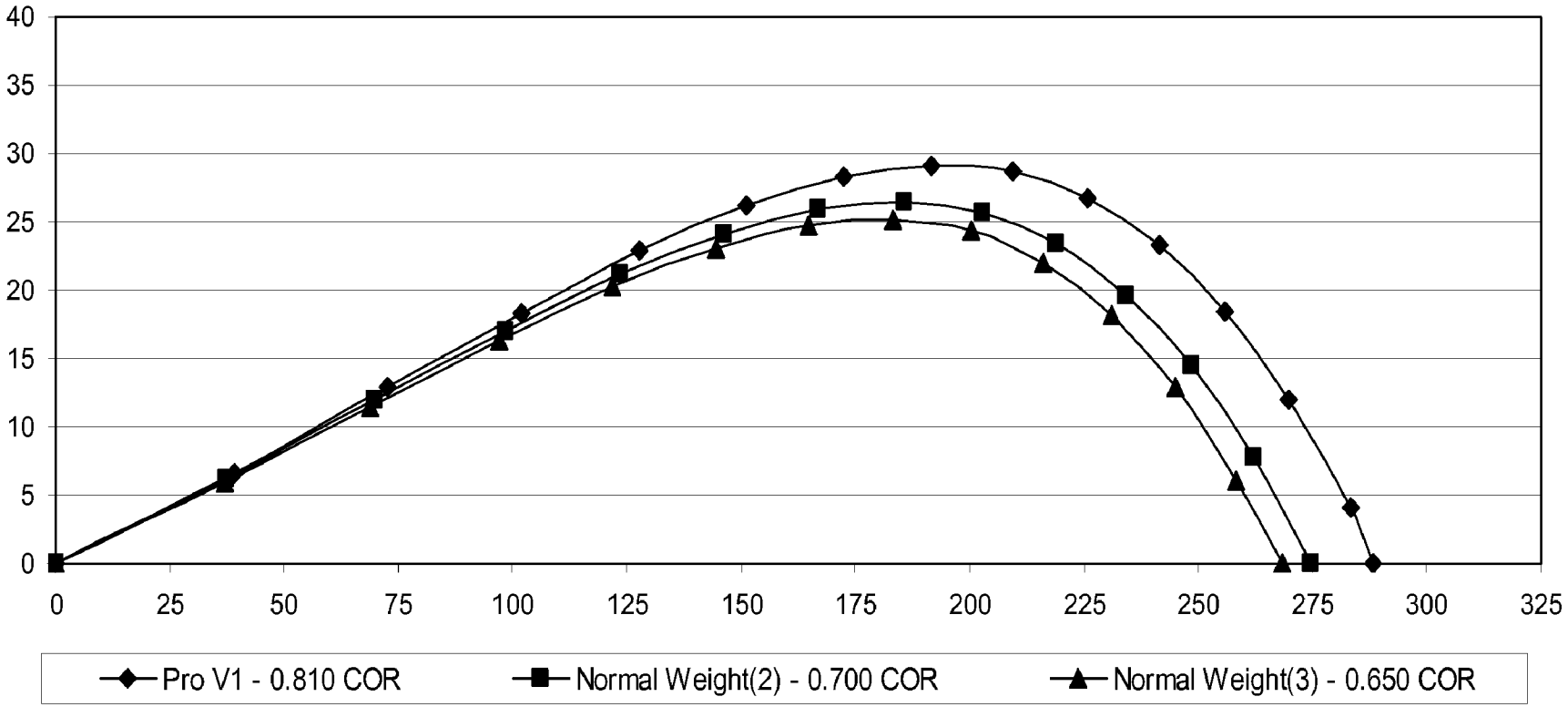
FIGS. 5-7 illustrate trajectory plots of inventive and comparative balls.
Figure 6:
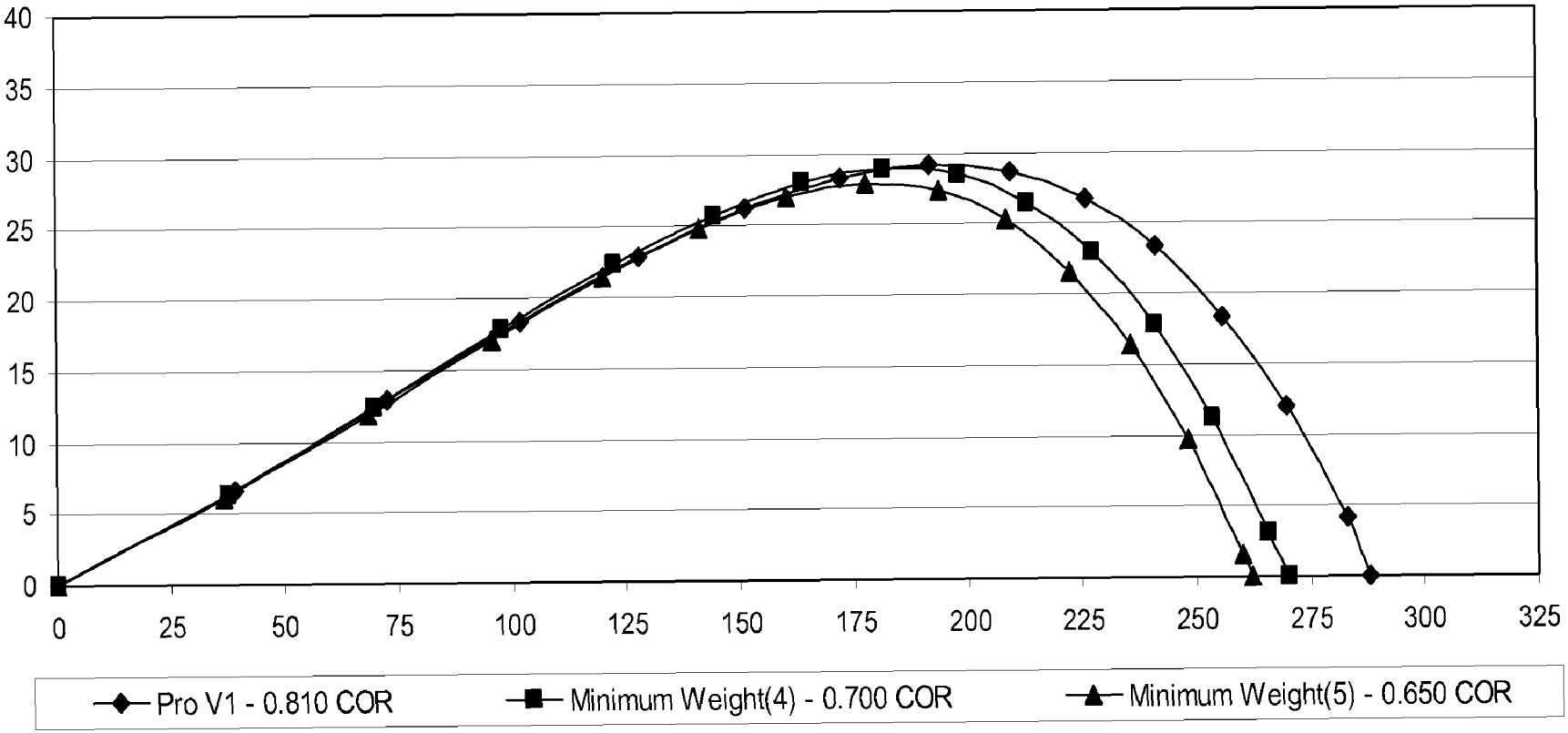
Figure 7:
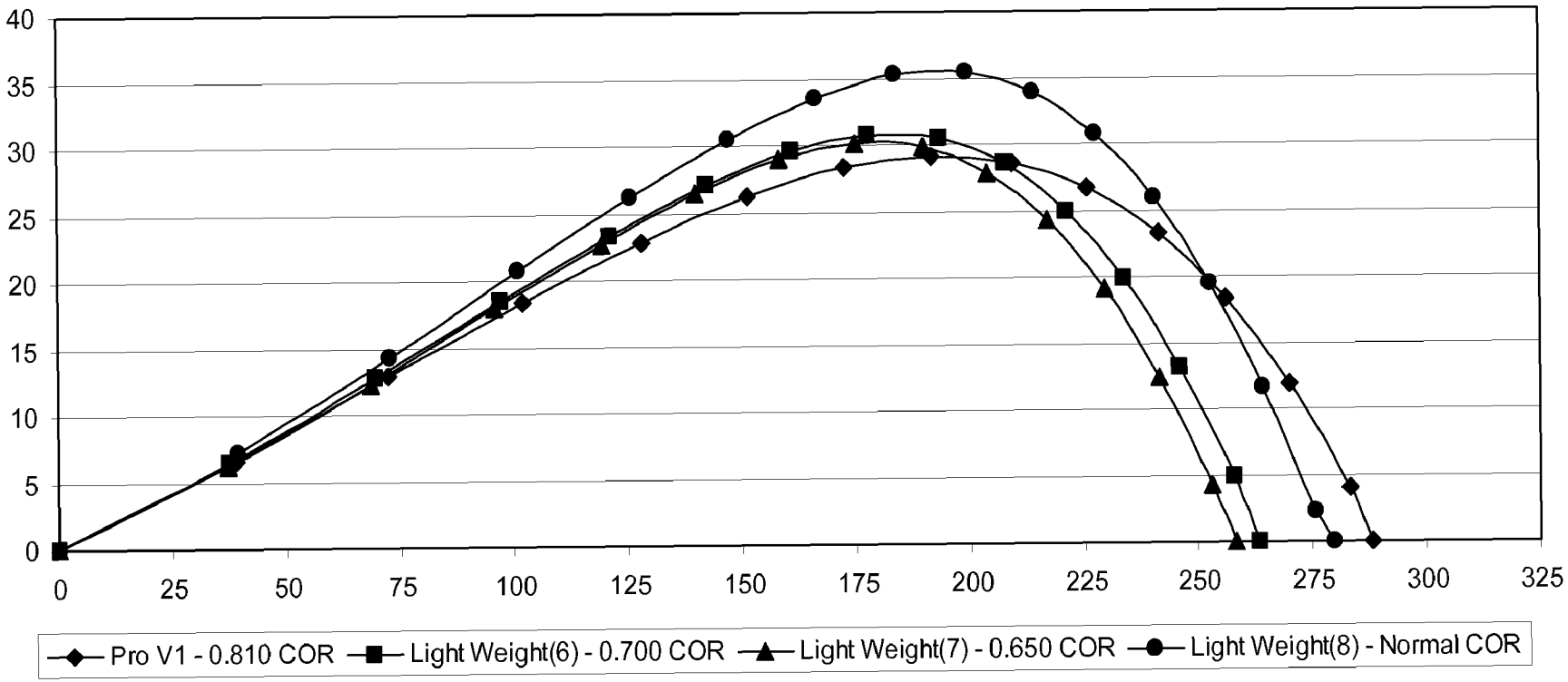

Table 8D shows the reduction in flight of low weight and/or low COR golf balls (2)-(8) according to various embodiments of the present invention as compared with the flight of a Pro V1® golf ball under identical launch conditions. FIGS. 5-7 show the respective flight trajectory of golf balls (2)-(8) that demonstrate the range of flight trajectories possible through the modification of these construction parameters. FIG. 6 illustrates a trajectory whose perceived flight path (when viewed from the golfer's viewpoint) matches that of a premium multilayer golf ball, but at a reduced distance.

TABLE 8D

FLIGHT OF REDUCED DISTANCE GOLF BALLS (2)-(8) HAVING LOW WEIGHT AND/OR LOW COR

| | | Flight | | |
|---|---|---|---|---|
| Ball | Weight/COR | Carry | Total | Δ from Control (1) |
| Pro V1 ® | Reference | 288.2 | 305.0 | −0.1 |
| Control (1) | Normal/Normal | 286.5 | 305.1 | 0.0 |
| (2) | Normal/0.700 | 274.6 | 292.8 | −12.3 |
| (3) | Normal/0.650 | 268.4 | 286.9 | −18.2 |
| (4) | 1.510 oz./0.700 | 270.1 | 285.1 | −20.0 |
| (5) | 1.510 oz./0.650 | 262.2 | 277.2 | −27.9 |
| (6) | 1.40 oz./0.700 | 263.5 | 276.6 | −28.5 |
| (7) | 1.40 oz/0.650 | 258.3 | 271.3 | −33.8 |
| (8) | 1.40 oz/Normal | 279.7 | 291.4 | −13.7 |

The data shows that when the weight of the ball is reduced and other factors remain substantially the same, as in the control ball 1 and ball 8, the total distance is reduced by 13.7 yards, while the cores' CORs and the balls' CORs are substantially similar. The weight difference between ball 1 and 8 is about 0.232 ounce. A comparison between ball 1, 2, and 3 again shows that the addition of butyl rubber reduces the COR and the total distance, and higher butyl rubber content further reduces the total distance traveled after impact as shown in FIG. 5.

Comparisons of trios of balls 2, 4 and 6 and of balls 3, 5 and 7 show that when the content of low resilient butyl rubber is kept substantially the same and the weight of the ball is reduced, the total distance traveled after impact decrease accordingly.

The results shown in Tables 8A-8D show that controlled weight reduction causes controlled reduction in total distance traveled after impact. The inclusion of low resilient rubber, such as butyl rubbers mixed with the high resilient rubber such as high-cis 1, 4 polybutadiene further reduces the total distance.

In another embodiment, a golf ball according to the present invention includes a low-resilient cover that is made to be slower than a conventional ball but as durable. Accordingly, the cover may be made from a mid-hardness (or mid-acid) ionomer blend, such as 70% Surlyn® 8528 and 30% of either Surlyn® 9650 or Surlyn® 9910 from E. I. duPont de Nemours and Company. In a further embodiment, the cover of the ball may be made of non-ionomers including: polyethylene, polypropylene, EPR, EPDM, butyl, and polybutadiene.

Hence, according to the present invention, by controlling the COR through the introduction of low resilient rubber, lowering the weight of the ball, thickening the cover made from low resilient ionomers, increasing the size of the ball, reducing the dimple coverage and increasing the dimple edge angle, $C_{D/W}$ and $C_{L/W}$ coefficients, and/or combinations and sub-combinations thereof, a high performance ball that has reduced total distance after impact can be produced.

As shown in FIG. 6, while the total distance after impact is reduced the trajectory of the ball's flight remains similar to the control ball 1 or premium multilayer ball, which is the current best selling golf ball. Particularly, the trajectory for all balls is substantially the same in the first seventy yards. As illustrated, the variation in elevation of the ball at 70 yards is less than 3 yards, preferably less than 2 yards and most preferably less than the 1 yard. The variation in elevation at 120 yards is preferably less than 5 yards, more preferably less than 3 yards and most preferably less than 1 yard. Advantageously, by maintaining similar trajectory as an optimal high performance ball, the golf balls of the present invention provide to professional and amateur golfers the same perceived trajectory from the golfer's viewpoint as a maximum distance high performance ball.

While various descriptions of the present invention are described above, it is understood that the various features of the embodiments of the present invention shown herein can be used singly or in combination thereof. For example, the dimple depth may be the same for all the dimples. Alternatively, the dimple depth may vary throughout the golf ball. The dimple depth may also be shallow to raise the trajectory of the ball's flight, or deep to lower the ball's trajectory. This invention is also not to be limited to the specifically preferred embodiments depicted therein.

Additionally, any dimple pattern for a golf ball disclosed in the patent literature or commercial products can be suitably adapted to be incorporated into the present invention, i.e., by reducing the dimple coverage to 55-75% and by increasing edge angle of the dimples to 16-24 degrees. Such dimple pattern patents include, but are not limited to the ones assigned to the owner of the present invention, U.S. Pat. Nos. 4,948,143, 5,415,410, 5,957,786, 6,527,653, 6,682,442, 6,699,143, and 6,705,959.

Dimple pattern patents assigned to others may also be suitably adapted for use with the present invention. Non-limiting examples of these suitable patents include U.S. Pat. Nos. 4,560,168, 5,588,924, 6,346,054, 6,527,654, 6,530,850, 6,595,876, 6,620,060, 6,709,348, 6,761,647, 6,814,677, and 6,843,736.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

What is claimed is:

1. A golf ball comprising:

a core; and a cover layer;

wherein the golf ball has a weight of about 1.39 oz to about 1.62 oz, and at a Reynolds number of about 138,000 and a non-dimensional spin ratio of about 0.142, the golf ball has a lift-to-weight ratio of greater than about 0.9 a drag-to-weight ratio of greater than about 1.2.

2. The golf ball of claim 1, wherein the core comprises polybutadiene, butyl rubber, a co-reaction agent, or a peroxide.

3. The golf ball of claim 2, wherein the butyl rubber is halogenated.

4. The golf ball of claim 1, wherein the golf ball has a coefficient of restitution of about 0.550 to 0.785.

5. The golf ball of claim 4, wherein the coefficient of restitution is about 0.600 to 0.780.

6. The golf ball of claim 1, wherein the weight is about 1.45 oz to about 1.60 oz.

7. The golf ball of claim 6, wherein the weight is about 1.45 oz to about 1.58 oz.

8. The golf ball of claim 1, wherein the golf ball has an outer diameter of about 1.675 in about to 1.695 in.

9. The golf ball of claim 1, wherein the dimple coverage is 55% to 75%.

10. The golf ball of claim 1, wherein the cover layer comprises an ionomer, non-ionomer, or polyurethane.

11. The golf ball of claim 1, wherein the golf ball comprises a casing or inner cover layer disposed between the core and the cover.

12. The golf ball of claim 11, wherein the inner cover or casing layer comprises an ionomer and the cover comprises a polyurethane.

13. The golf ball of claim 1, wherein the core comprises a polybutadiene, a co-reaction agent, a peroxide, and at least one of a butyl rubber, a halogenated butyl rubber, a butyl rubber copolymer, a sulfonated butyl rubber, a polyisobutylene, an ethylene propylene diene monomer rubber, a copolymer of isobutylene and methylstyrene, or a styrene butadiene rubber.

14. The golf ball of claim 1, wherein the cover layer comprises a urethane.

* * * * *